United States Patent [19]

Hamilton

[11] 4,166,328

[45] Sep. 4, 1979

[54] SHOE REPAIR DEVICE

[76] Inventor: James C. Hamilton, 6307 Valley Rd., Bethesda, Md. 20034

[21] Appl. No.: 781,568

[22] Filed: Mar. 28, 1977

[51] Int. Cl.[2] ..... A43B 13/22; A43B 5/00

[52] U.S. Cl. ..... 36/72 R; 36/132

[58] Field of Search ..... 36/72 R, 83, 114, 132, 36/136

[56] References Cited

U.S. PATENT DOCUMENTS

| | | | |
|---|---|---|---|
| 2,747,303 | 5/1956 | Abrahams | 36/72 R |
| 3,497,972 | 3/1970 | Lyman | 36/72 R |
| 3,974,578 | 8/1976 | Oettinger et al. | 36/72 R |

*Primary Examiner*—Patrick D. Lawson

*Attorney, Agent, or Firm*—Rose & Edell

[57] ABSTRACT

The invention provides a device for covering on a tennis shoe the worn area resulting from dragging the rear foot when hitting the ball and moving into the play, the device comprising a side wall having a curve generally conforming to the side and front of the shoe adjacent the big toe of the wearer and an integral bottom member that extends under the worn part of the sole, the device being fabricated from a tough material more flexible than the shoe whereby in conjunction with the shape of the device it will conform more easily to various different sizes of shoes having the worn area in various locations mainly beneath and forward of the big toe.

7 Claims, 4 Drawing Figures

SHOE REPAIR DEVICE

BACKGROUND OF THE INVENTION

The present invention relates generally to devices for repairing athletic shoes and more particularly to a device for repairing the worn front sole or tip portion of a tennis shoe.

As described in U.S. Pat. No. 3,974,578, it is well known to provide various methods and devices for repairing the front or tip portion of the sole of a tennis shoe which has been worn excessively with respect to the rest of the shoe as a result of dragging the back foot when hitting the ball.

One such solution is the placing of a hollow, generally hemispherical, rubber device over the tip of the shoe and gluing it in place. The present inventor accomplished this for many years by cutting an old tennis ball in half and gluing it over the front of his worn shoe.

Such devices are somewhat effective but are uncomfortable and do not truely conform to the contours of the shoe. As a result of the latter defect, gluing is at points or along relatively short surfaces of contact and the device does not hold as well as desired. Also edges of the device do not properly conform to adjacent surfaces of the shoe and soon come loose. Additional problems of producing an effective bond and providing a comfortable device result from the added stiffness of the shoe resulting from such a device. The landing material is strained due to non-compliance of the device with movement of the shoe. Discomfort results from the feeling of bulk incident to a mass of material across the front portion of the sole of the shoe and the incidental stiffness over the toes.

An object of the present invention is to provide a device for repairing the worn tip of a shoe, which device may be applied so as to cover only that lateral part of the sole of the shoe that is worn.

Another object of the present invention is to provide a device for repairing the worn tip of a tennis shoe which device is fabricated from a material more flexible than the sole or side of the shoe so as to be able to adjust and conform more closely and easily to the toe portion.

Yet another object of the present invention is to provide a topless device for repairing the worn front part of the sole and front of a tennis shoe which device has a curved vertical member for bonding to the side and front of the shoe and a bottom member having an outer edge extending between the ends of the curved vertical member, the vertical member following a gradually increasing curve between surfaces lying generally perpendicular to one another so that the device may be adjustably positioned by moving forward or backward and rotatable to conform to the side and only that part of the vertical part of the shoe that lies generally in front of the worn part and the nearest side of the shoe.

SUMMARY OF THE INVENTION

According to the present invention, the device comprises only generally vertical side and horizontal bottom parts fabricated from a highly flexible but tough material, for instance, natural or latex rubber with or without additive. (Directions as used herein refer to the arrangement of the parts when applied to a shoe when being worn.) Mirror image members are provided for left and right shoes since the device of the invention is asymmetrical.

In the horizontal plane, the side member has a generally straight side part terminating in a forward part of increasing curvature generally conforming to the side to front curve of the side of the shoe adjacent the big toe of the wearer. The forward part of the side member is adapted to terminate not beyond the midpoint of the front of the shoe. The side member is of a maximum height to terminate adjacent the upper edge of the side of the shoe so that it does not impinge on the toe area of the top of the shoe, thereby insuring no cramping of the toes.

The device of the invention has a bottom surface which extends over an area defined, along one edge, by the intersection of the side and bottom parts of the device and along the outer edge by a convex edge surface extending between the front and rear ends of the side member. The bottom member is tapered in all directions from its thickest region just forward of the big toe of the wearer to its outer edge so as to eliminate an abrupt termination of the bottom surface under the sole of the foot of the wearer. The convex curvature of the edge insures that the device extends under the worn sole of the shoe which usually covers a disproportionately larger transverse region near the front of the shoe than further back along the sole of the shoe.

As a result of the above construction the device may be readily adjusted in position to cover the worn part of shoes having different locations of wear and to shoes of greatly varying sizes by cutting parallel to the edges of the device whereby its basic unique shape is unchanged.

The device is located on the shoe with the outer edge of the bottom extending slightly beyond the worn area. The device is pulled toward the rear of the shoe so that the side wall engages the side and front walls of the shoe. Due to the contouring of the device as set forth above and its resiliency, the device will remain in contact with the great majority of adjacent regions and may therefore, be strongly bonded to the shoe.

DESCRIPTION OF THE PREFERRED EMBODIMENT

Figure 3:
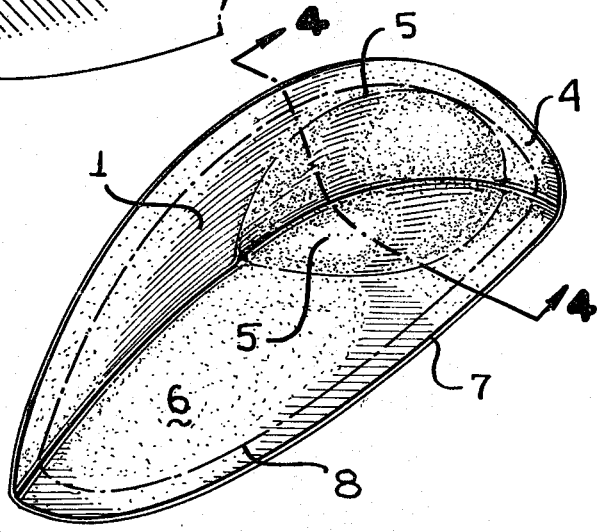
FIG. 3 is a perspective view looking into the device of the invention.

Referring specifically to the drawings, there is illustrated the device of the present invention. The device comprises a side member 1 having a first part 2 that is generally straight and which towards the front part of the shoe curves in a region 3 at an increasing angle to the right as illustrated in FIG. 3; the angle increasing in curvature at about the same rate as the left front part of a right shoe.

The illustrated device is for use with the right shoe of a right-handed person. The device for a left-handed person is a mirror image of the illustrated device and is applied to the right side of the left shoe of the wearer.

Figure 4:
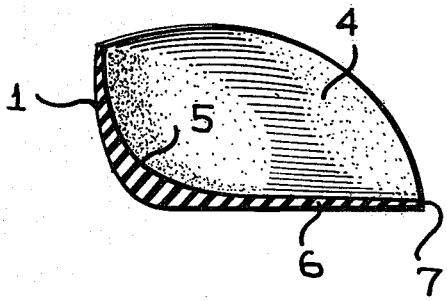
FIG. 4 is a sectional view taken along section line 4—4 of FIG. 3.

Returning to the description of the drawings, a front part 4 of the side member lies at about a right angle to the region 2, although such is not critical. The side member 1, as particularly illustrated in FIG. 4 is inclined slightly outward so as to conform to the tennis shoe. A region 5 illustrated in FIGS. 3 and 4, the dotted line region in FIG. 3, is thickened to cover and compensate for the worn away region 5' of the shoe. A point of maximum wear 5'' lies in line with and just in front of the big toe of the wearer.

The device includes a horizontal member 6 which covers the area between the intersection of the bottom 6 and wall 1 and a convex surface 7 extending between the two ends of the side wall. The member 6 is tapered being thickest adjacent wall 1 and thinnest along the surface 7. The member 6 is also tapered from its thickest region at the POINT 5'' of the wearer and from that point tapers to a thin edge at its edge surface 7.

Figure 1:
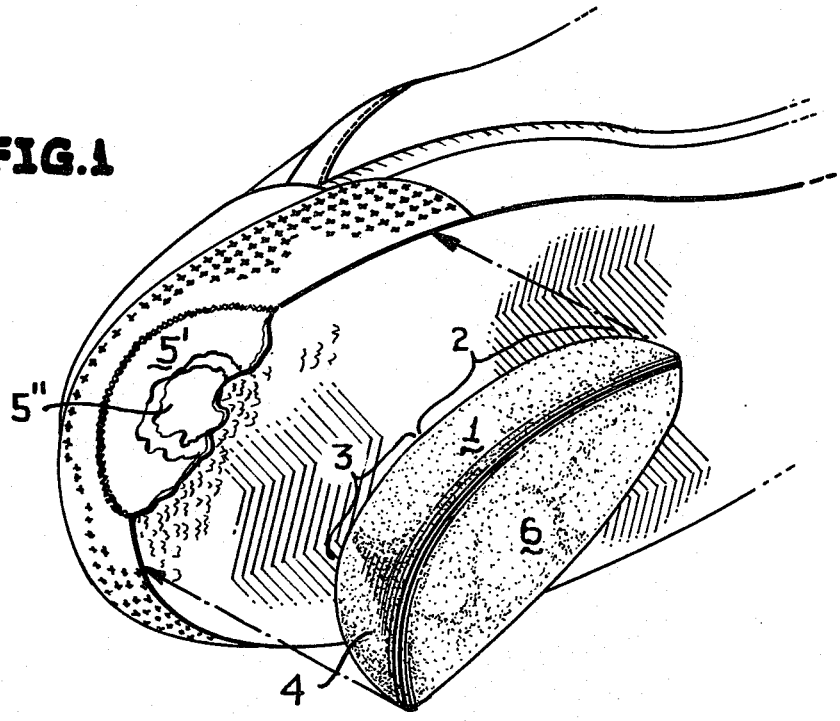
FIG. 1 is a perspective exploded view of a worn area of a tennis shoe with the device of the present invention removed from but adjacent said area.
Figure 2:
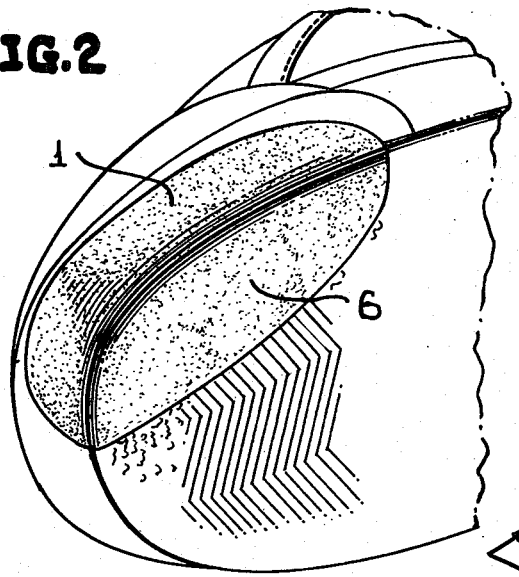
FIG. 2 is a perspective view of the device of the invention applied to a shoe.

Referring to FIG. 2, the device is illustrated applied to a tennis shoe. It is quite apparent that all tennis players do not drag the foot on the power side exactly the same and thus the wear region of shoe varies from player to player. Also, of course the sizes of shoes cover quite a range. Thus, the adjustability with comfort of the device of the present invention becomes quite important. It can be seen from FIGS. 1 and 2 that by merely moving the device forward and down the device may readily cover a somewhat centrally located worn region 5' while by moving the device rearward and upward a more outwardly located worn area is covered.

The desire to adjust the device relative to the worn area stems from the fact that a more nearly "seamless" intersection of the member of the device and the sole of the shoe can be effected if the edge 7 of the member 6 lies at the approximate edge of the worn area and the region 5 of increased thickness lies under the most heavily worn area.

The ease of locating the device on the shoe and of obtaining good bonding over a range of locations is due to the flexibility of the material coupled with the proper contouring of the device as set forth above whereby relatively minor dislocations of the device relative to shoe may be overcome by flexing the device locally.

While I have described and illustrated one specific embodiment of my invention, it will be clear that variations of the details of construction which are specifically illustrated and described may be resorted to without departing from the true spirit and scope of the invention as defined in the appended claims.

I claim:

1. A device for covering a worn area on a shoe comprising an opened topped member of flexible material having a side wall and a bottom member lying in a plane generally at right angles to said side wall, said side wall having an upper edge and extending from a first region of the shoe intended to lie under the ball of the foot of the foot of the wearer and terminating at a second region adjacent the longitudinal center of the front of the shoe, said side wall having a generally straight section along the side of the shoe and a section of increasing curvature adjacent the intended location of the big toe of the wearer whereby the curvature of said side wall conforms to the side of the shoe between said first and second regions, said bottom member having an outer edge extending between said ends of said side wall, and said device having a region of maximum thickness in the region of said device intended to lie both under the big toe and forward of the big toe of the wearer of the shoe, said device tapering from said maximum thickness to a lesser thickness at said upper edge, said first and second regions and said outer edge.

2. A device for covering a worn area on a shoe according to claim 1 wherein a part of said region of maximum thickness lies in line between the intended location of the big toe of the wearer of the shoe and the surface supporting the shoe, said bottom wall tapering from said region of maximum thickness to a region of minimum thickness along said outer edge of said bottom member of said device.

3. A device for covering a worn area on a shoe according to claim 1 wherein said device is made from a material of greater flexibility than the sole and side walls of the shoe to which it is to be applied.

4. The device according to claim 1 wherein said side wall has a maximum height approximately the same as the side of the shoe to which it is to be applied.

5. The device according to claim 1 wherein said outer edge of said bottom member is convex and extends beyond the center of the shoe to which said device is intended to be applied.

6. The device according to claim 1 wherein said bottom member tapers from said region of maximum thickness to a minimum thickness along said outer edge of said bottom member of said device.

7. The device according to claim 6 wherein said outer edge is convex.

* * * * *

REEXAMINATION CERTIFICATE (757th)

United States Patent [19]

Hamilton

[11] B1 4,166,328

[45] Certificate Issued Sep. 15, 1987

[54] SHOE REPAIR DEVICE

[76] Inventor: James C. Hamilton, 6307 Valley Rd., Bethesda, Md. 20034

Reexamination Request:
No. 90/001,151, Jan. 14, 1987

Reexamination Certificate for:

| | |
|---|---|
| Patent No.: | **4,166,328** |
| Issued: | **Sep. 4, 1979** |
| Appl. No.: | **781,568** |
| Filed: | **Mar. 28, 1977** |

[51] Int. Cl.[4] ..... A43B 13/22; A43B 5/00
[52] U.S. Cl. ..... 36/72 R; 36/132
[58] Field of Search ..... 36/72 R, 83, 114, 132, 36/136

[56] References Cited

U.S. PATENT DOCUMENTS

| | | | |
|---|---|---|---|
| 241,391 | 5/1881 | McDonald | 36/71.5 |
| 1,525,581 | 2/1925 | Golden | 36/72 |
| 2,040,001 | 5/1936 | Jones | 36/2.5 |
| 2,485,706 | 10/1949 | Cruise | 36/73 |
| 2,710,463 | 6/1955 | Liska | 36/71.5 |
| 2,864,180 | 12/1958 | Montgomery | 36/72 |
| 3,028,689 | 4/1962 | Dassler | 36/2.5 |

FOREIGN PATENT DOCUMENTS 3895 of 0000 United Kingdom .

*Primary Examiner*—Werner H. Schroeder

[57] ABSTRACT

The invention provides a device for covering on a tennis shoe the worn area resulting from dragging the rear foot when hitting the ball and moving into the play, the device comprising a side wall having a curve generally conforming to the side and front of the shoe adjacent the big toe of the wearer and an integral bottom member that extends under the worn part of the sole, the device being fabricated from a tough material more flexible than the shoe whereby in conjunction with the shape of the device it will conform more easily to various different sizes of shoes having the worn area in various locations mainly beneath and forward of the big toe.

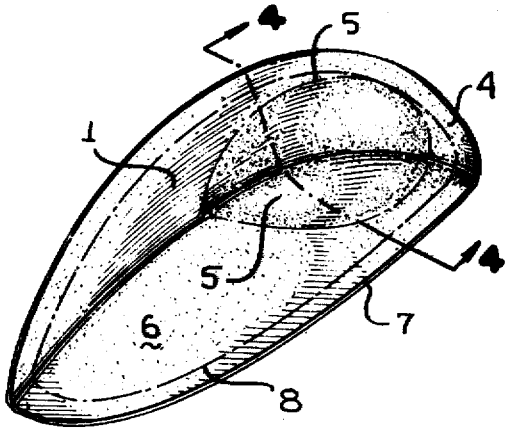

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-7 is confirmed.

* * * * *